United States Patent [19]

Heinemann et al.

[11] 4,133,488

[45] Jan. 9, 1979

[54] ROLLER MILL WITH REMOVABLE SEPARATOR STRUCTURE

[75] Inventors: Otto Heinemann, Ennigerloh; Heinz-Herbert Schmits, Rheda-Wiedenbruck; Heinz-Dieter Baldus, Ahlen, all of Fed. Rep. of Germany

[73] Assignee: Polysius AG, Neubeckum, Fed. Rep. of Germany

[21] Appl. No.: 828,277

[22] Filed: Aug. 29, 1977

[30] Foreign Application Priority Data

Sep. 16, 1976 [DE] Fed. Rep. of Germany ..... 2641620

[51] Int. Cl.[2] ..... B02C 23/10

[52] U.S. Cl. ..... 241/79; 241/107; 241/285 A; 241/301

[58] Field of Search ..... 241/107, 115, 117, 123, 241/207, 209, 285 A, 286, 290, 301, 79

[56] References Cited

U.S. PATENT DOCUMENTS

| | | | |
|---|---|---|---|
| 3,169,712 | 2/1965 | Schauer et al. | 241/117 |
| 3,782,646 | 1/1974 | Brundick | 241/117 |
| 4,018,396 | 4/1977 | Shoemaker et al. | 241/285 R |

*Primary Examiner*—Granville Y. Custer, Jr.
*Attorney, Agent, or Firm*—Jones, Thomas & Askew

[57] ABSTRACT

A roller mill assembly includes a separator disposed above a roller mill housing, and an exhaust air duct above the separator. The sieve is movable horizontally from between the mill housing and the exhaust air duct on a crane track.

7 Claims, 5 Drawing Figures

ROLLER MILL WITH REMOVABLE SEPARATOR STRUCTURE

In prior art roller mills, the grinding rollers, usually two, three or four single or double rollers, must on occasions be removed from and returned to the mill housing for maintenance purposes or if replacement becomes necessary. Since the separator disposed above the mill housing precludes access to the rollers from above, the mill housing usually has lateral doors via which the rollers can be extracted or returned by means of special lifting or pivoting mechanisms.

The incident difficulties are, however, constantly increasing due to the rising weight of the rollers as the sizes of the mills and rollers become greater. Along with the difficulties of removing and replacing rolls from the mill housing there is, however, not only an increase in the cost of the equipment needed but also a lengthening of the time spent in these operations and hence in the inoperative periods of the mill.

The invention is therefore directed to the problem of avoiding these difficulties while providing a roller mill of the type described, wherein the rollers can be simply and quickly removed and replaced.

According to the invention this problem is solved in that the separator is supported on a crane track, and after disconnection from the mill housing and the exhaust air duct can be moved along the crane track until the mill rollers are accessible to a crane also movable along the same track.

The invention makes use of the fact that such a roller mill is usually erected in a workshop equipped with a travelling crane. If it is then made possible for the separator, after disconnection from the mill housing and from the exhaust air duct to be moved along the crane track (relative to the fixed position mill housing) then the interior of the mill housing and in particular the grinding rollers become readily accessible to the travelling crane and can be comfortably removed and replaced by that crane.

In this manner it becomes no longer necessary to provide separate lifting and pivoting mechanisms for removing and replacing the grinding rollers, with large doors in the top portion of the mill.

A further advantage is that the mill housing is relieved of the operating weight of the separator and hence can have smaller dimensions.

The disconnection of mill and separator also reduces the transmission of oscillations and permits a lighter construction for mill and separator. The relief of the separator load from the mill housing also provides the possibility of supporting the separator on load cells which enable misfunctioning through the separator filling up to be promptly detected.

If the sieve is moved laterally relative to the mill housing in the manner described, then not only the grinding rollers in the mill but numerous further components therein, for example most of the hydraulic elements, also become accessible to the travelling crane.

Desirable aspects of the invention, as for example the centrally operated dust- and gas-tight connector members between the separator housing and the mill housing or exhaust air duct, form the subject of subsidiary claims, and will be explained in more detail in conjunction with the description of an embodiment shown in the drawings.

Figure 1:
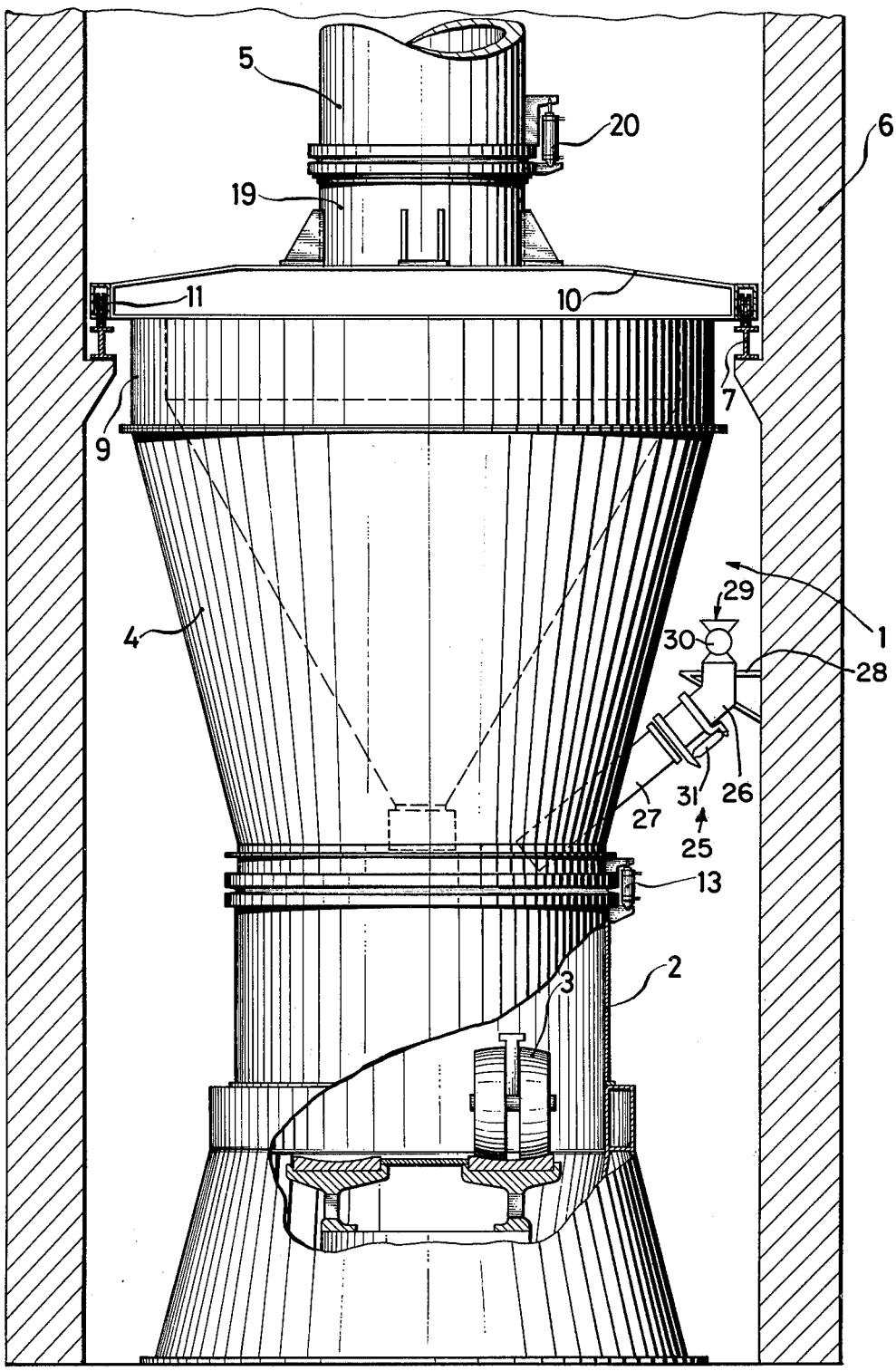
FIG. 1 is a side view of a roller mill in accordance with the invention.

The roller mill 1 shown has a mill housing 2 containing a plurality of grinding rollers 3 (in this embodiment three double rollers are provided at 120° intervals).

Above the mill housing 2 is a separator 4, which may for example be a dynamic or a static separator. The details of the separator are not important to the invention and hence are not shown. Above the separator 4 is an exhaist air duct 5.

The roller mill is located in a workshop 6, only indicated schematically, and provided with a crane track 7 for supporting the separator 4 and for supporting a travelling crane 8.

Material is fed into the mill through a feed tube assembly 25. The feed tube assembly 25 comprises a stationary tubing section 26 mounted by a bracket 28 to the walls of the workshop 6 and also includes a movable tubing section 27 attached to the separator 4. The stationary tubing section 26 includes a material inlet 29 and a charging valve 30. The stationary tubing section 26 and movable tubing section 27 are joined by a separable connection 31 similar to that shown in FIG. 3 and explained more fully below.

The housing 9 of the separator is suspended from a support frame 10 which rests via four wheels 11 on the said crane track 7.

Figure 2:
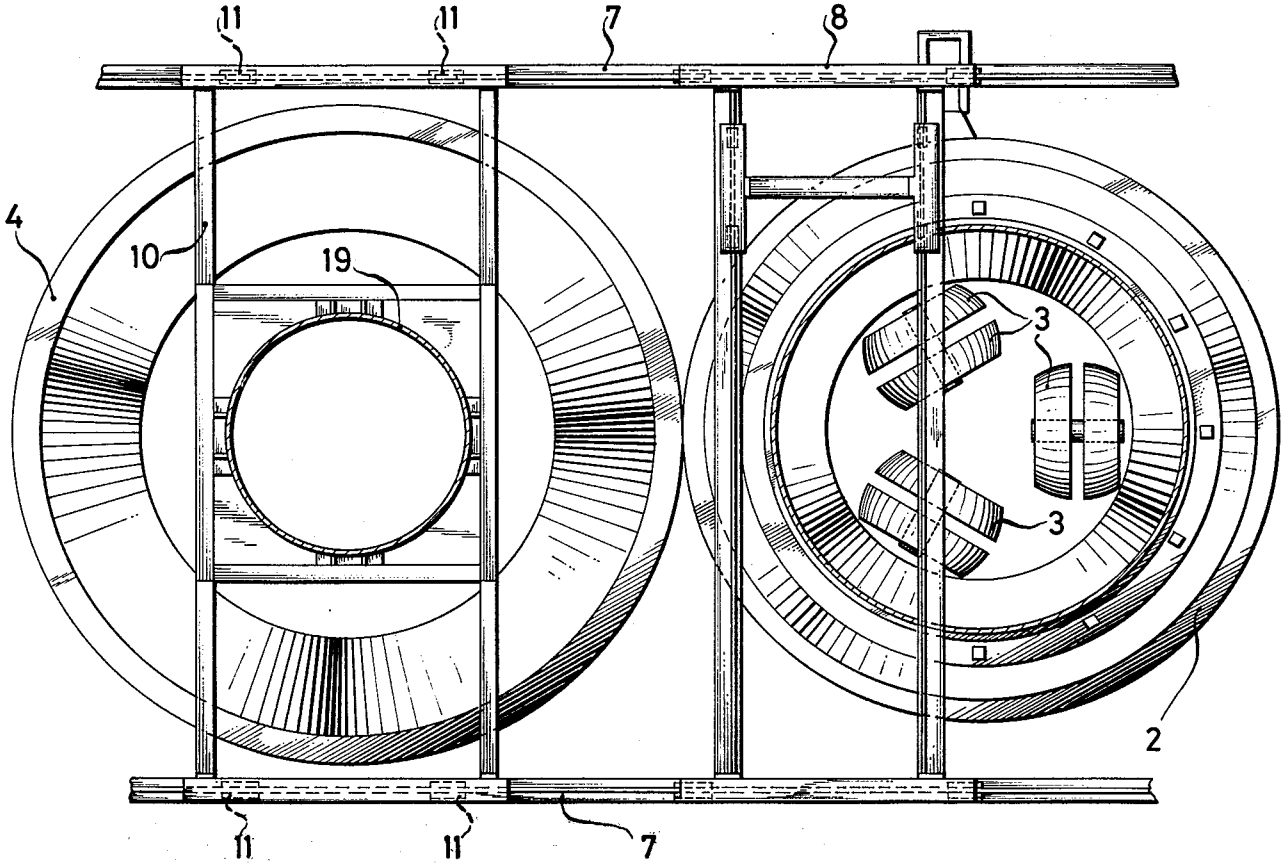
FIG. 2 is a plan view of the roller mill, with the separator moved laterally away, and the travelling crane above the mill housing.

After separation of the connection (explained more fully below) of separator 4 with the mill housing 2 and with the exhaust air duct 5, the separator 4 can be moved horizontally along the crane track 7 until the interior of the mill housing 2, and in particular the grinding rollers 3, are readily accessible from above to the travelling crane 8 (see FIG. 2).

Figure 3:
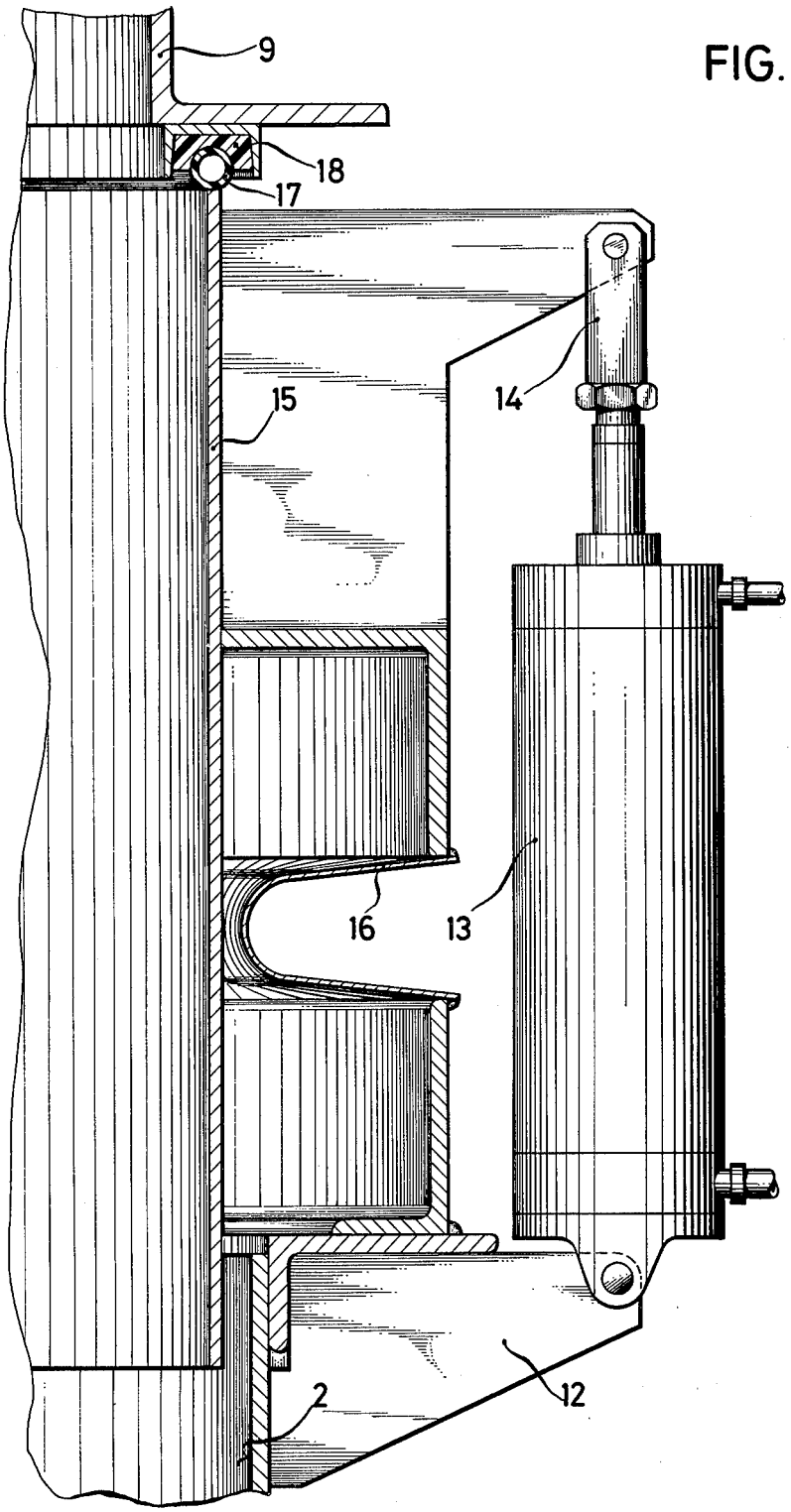
FIG. 3 is a detail to show the seal between the mill housing and the separator housing.
Figure 4:
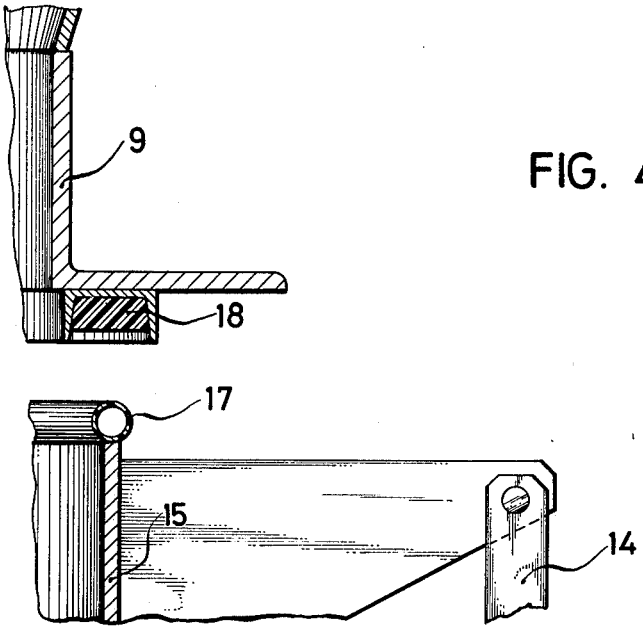
FIG. 4 is a detail from FIG. 3, with the seal in open position.

FIGS. 3 and 4 show the details of the sealed joint between the mill housing 2 and the separator housing 9. Pivotally connected to a bracket 12 of the mill housing 2 there is a pressure medium cylinder 13 whose piston rod 14 is on the one hand joined via a resilient diaphragm 16 to the mill housing 2 and on the other hand has at its upper edge a sealing bead 17 which co-operates with a resilient sealing element 18 at the underedge of the separator housing 9.

In the position shown in FIG. 3, the sealing bead 17 and the sealing element 18 constitutes a dust- and gas-tight joint between the mill housing 2 and the separator housing 9. FIG. 4 however shows the seal components in a position retracted by the pressure cylinder 13, and in which the separator 4 can be moved laterally relative to the mill housing 2.

Figure 5:
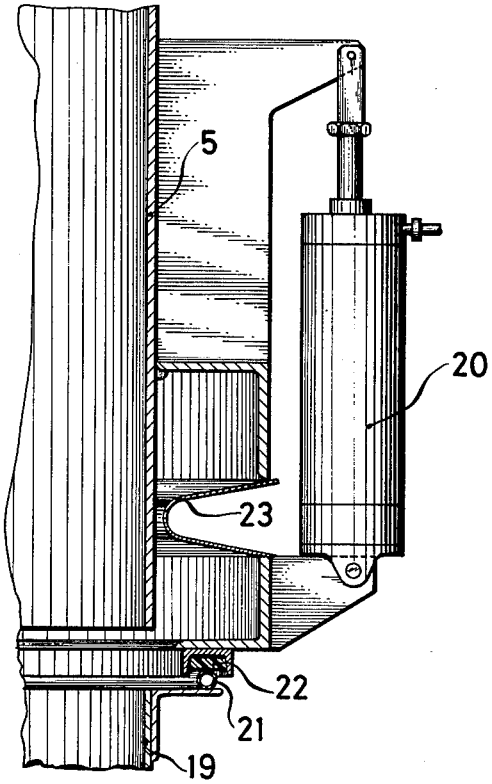
FIG. 5 is a detail to show the seal between the separator housing and the exhaust air duct.

A similarly constructed sealing joint is provided between the exhaust air pipe 19 of the separator housing 9 and the exhaust air duct 5 (see FIG. 5). This air duct 5 is connected to a pressure medium cylinder 20 which in the sealing position holds together in resilient engagement a sealing bead 21 and a sealing element 22, while in the upwardly retracted position it disconnects them. A diaphragm 23 permits movement of the sealing element 22 relative to the exhaust air duct 5 while maintaining a dust- and gas-tight joint.

While this invention has been described in detail with particular reference to preferred embodiments thereof, it will be understood that variations and modifications can be effected within the spirit and scope of the invention as described hereinbefore and as defined in the appended claims.

What we claim is:

1. A roller mill including a mill housing with mill rollers therein, a separator positioned above said mill housing, and an exhaust air duct positioned above said separator, the combination therewith of track means extending from adjacent said roller mill to a position beyond said roller mill for supporting said separator and for guiding said separator horizontally from between said mill housing and said exhaust duct, whereby said separator can be removed from between the mill housing and the exhaust duct and moved along the track until the mill rollers in the mill housing are accessible to a crane or the like movable along the same track.

2. A roller mill as in claim 1, characterised in that between said separator on the one hand and said mill housing and said exhaust air duct on the other hand there are provided resilient seals which can be moved generally perpendicular to the crane track in order to seal said separator to said mill housing and to said exhaust air duct.

3. A roller mill as in claim 1, characterised in that at the upper end of said mill housing there is provided a ring vertically adjustable by a pressure-medium cylinder and connected via a resilient diaphragm to said mill housing, wherein said separator and the upper edge of said adjustable ring comprise co-operating sealing members.

4. A roller mill as in claim 1, characterised in that said separator is suspended from a support frame which is supported by runner wheels on said track.

5. A roller mill assembly comprising a mill housing, a separator structure located over said mill housing, and an exhaust duct located over said separator structure; lower seal means for releasably sealing said separator structure to said mill housing, upper seal means for releasably sealing said separator structure to said exhaust duct, and means for guiding said separator structure horizontally into and out of alignment between said mill housing and said exhaust duct.

6. The roller mill assembly of claim 5 and wherein said means for guiding said separator structure horizontally into and out of alignment between said mill housing and said exhaust duct comprises a track supporting said separator structure, and further including a crane supported on said track.

7. The roller mill assembly of claim 5 and wherein said lower seal means comprises a stationary seal element attached to one of said separator structure and said mill housing, a movable seal element attached to the other of said separator housing and said mill housing and movable into and out of engagement with said first stationary seal element and fluid actuated power means for moving said movable seal element into and out of engagement with said stationary seal element and wherein said upper seal means comprises a stationary seal element attached to one of said separator structure and said exhaust duct, a movable seal element attached to the other of said separator structure and said exhaust duct and movable into and out of engagement with said stationary seal element and fluid actuated power means for moving said movable seal element into and out of engagement with said stationary seal element.

* * * * *